United States Patent [19]

Ting et al.

[11] Patent Number: 4,856,466

[45] Date of Patent: Aug. 15, 1989

[54] LUBRICANT RETAINING FINGER-FOLLOWER ROCKER ARM

[75] Inventors: Loi-Lou Ting, Ann Arbor; Granger K. Chui, Dearborn Heights; Edward T. King, Dearborn, all of Mich.

[73] Assignee: Ford Motor Company, Dearborn, Mich.

[21] Appl. No.: 250,476

[22] Filed: Sep. 28, 1988

[51] Int. Cl.[4] ..... F01L 1/18; F01M 9/10

[52] U.S. Cl. ..... 123/90.33; 123/90.44

[58] Field of Search ..... 123/90.27, 90.33, 90.34, 123/90.39, 90.44, 196 R

[56] References Cited

U.S. PATENT DOCUMENTS 2,322,172 6/1943 Spencer .
2,572,968 10/1951 Bachle .
4,565,168 1/1986 Rivere ..... 123/90.34
4,614,171 9/1986 Malhotra ..... 123/90.44
4,643,141 2/1987 Bledsoe ..... 123/90.16

*Primary Examiner*—Charles J. Myhre
*Assistant Examiner*—Weilun Lo
*Attorney, Agent, or Firm*—Clifford L. Sadler; Jerome R. Drouillard

[57] ABSTRACT

A finger-follower rocker arm type valve train has a finger-follower rocker arm with an upper surface that extends essentially unbroken from end to end with a central area surface for contact with an overhead cam, the central area surface being concave for lubricant retention purposes and having additional lubricant retaining pockets in the surface as reservoirs to maintain lubricant at the surface at all times regardless of the operability of inoperability of the engine camshaft.

10 Claims, 2 Drawing Sheets

LUBRICANT RETAINING FINGER-FOLLOWER ROCKER ARM

Figure 1:
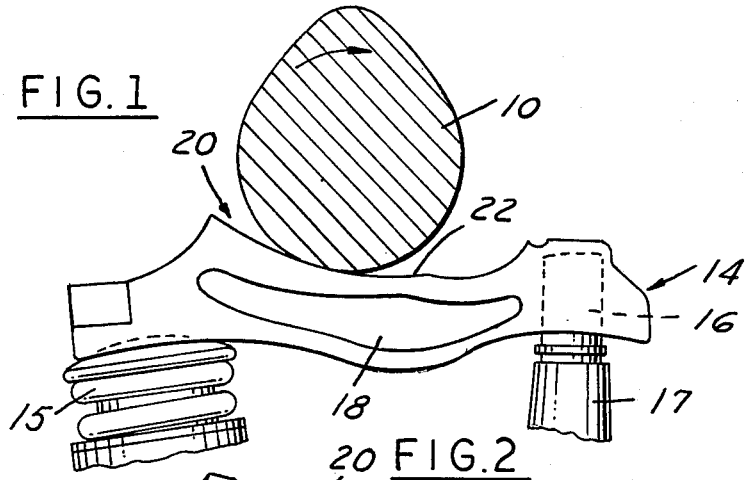

This invention relates in general to an automotive internal combustion engine type valve train. More particularly, it relates to a valve train including a finger-follower type rocker arm of a construction reducing friction and wear between the parts.

The conventional finger follower type rocker arm has a convex surface that is contacted by the convex surface of a cam of an automotive type internal combustion engine. Because of the convex geometry, it is difficult for the conventional finger-follower to retain lubricating oil at the contact area after the engine is turned off and the camshaft ceases to rotate. When the engine is restarted after a long shutdown, the cam and follower, therefore, will operate without adequate lubrication until the oil pump can deliver oil from the oil sump.

Oil starvation at the contact area generally increases friction and wear. Results from a bench experiment conducted to examine the effects of delayed lubrication on the wear of the cam lobes and followers showed that increasing the lubrication delay time; i.e., the time for the oil from the reservoir to reach the cam follower, from one to three minutes, greatly increased the amount of wear. Oil delay to the valve train of an overhead cam type engine has been known to be a source of cam failure. This is especially critical for engines with long oil delivery passages and in cold climate operation where the oil viscosity is high and the oil flow is slow during engine cold start.

This invention relates to a conformal contact cam/-finger-follower rocker arm system that provides a local reservoir at each follower to retain oil during engine shutdown so that lubrication is immediately available on the next restart. Both friction and wear, therefore, are substantially reduced and premature valve train wear and failure due to delayed oil delivery can be minimized.

It is, therefore, a primary object of the invention to provide a finger-follower type rocker arm with a concave cam contact surface that will retain lubricant at all times to reduce friction and wear between the parts.

The use of a concave surface on a finger-follower type rocker arm is known. For example, Bledsoe, U.S. Pat. No. 4,643,141, shows in FIGS. 3–5 a concave surface 36 contacted by the cam for actuating the finger-follower and valve stem. However, there is no provision stated or shown for maintaining the contact area between the cam and follower surface lubricated at all times.

Soencer, U.S. Pat. No. 2,322,172, shows somewhat of a finger-follower type rocker arm. However, in this case, a roller is journalled on the rocker arm in a recessed portion of the rocker arm, rather than having a concave surface engaged directly by the cam. Therefore, it resembles a conventional rocker arm with a pivoted roller.

Bachle, U.S. Pat. No. 2,572,968, shows a channel-type rocker arm with a cross-member contact surface 22 that is concave. However, again, the rocker arm is not a solid, essentially continuous piece from end to end with oil retaining pockets in the contact area. Furthermore, the construction is not an overhead cam type, wherein a cam engages the contact surface. In this case, the contact surface 22 serves as a fulcrum.

Malhotra, U.S. Pat. No. 4,614,171, and Rivere, U.S. Pat. No. 4,565,168, are other illustrations of conventional-like channel shaped rocker arms that can contain oil reservoirs; however, they are not of the finger-follower type and do not have concave surfaces that are engaged by the cam.

A further object of the invention, therefore, is to provide a finger-follower rocker arm construction in which the rocker arm has an upper surface that is essentially continuous from end to end and wherein the central contact area with the cam is concave with a plurality of oil or lubricant retaining pockets to maintain lubricant at the contact surface at all times.

Other objects, features and advantages of the invention will become more apparent on reference to the succeeding, detailed description thereof, and to the drawings illustrating the preferred embodiments thereof; wherein:

FIG. 1 is a cross-sectional view illustrating schematically a finger-follower rocker arm constructed according to the invention; and FIGS. 2–6A are perspective views of the finger-follower of FIG. 1 illustrating other embodiments of the invention.

FIG. 1 shows an overhead cam type valve train in which a cam 10 is mounted on a camshaft, not shown, of an internal combustion engine above the conventional cylinder head. The cam engages or contacts a rocker arm 14 of the finger-follower type that extends longitudinally for engagement at one end with the stem 15 of a valve of the engine. The other end 16 has a socket adapted to be engaged by a lash adjuster 17 constituting a fulcrum for the finger-follower. It will be clear that rotation of the cam 10 in the direction indicated will rock or pivot the finger-follower 14 about the fulcrum 16 to thereby actuate the valve stem in the desired manner.

The finger-follower in this case is essentially a solid member, except for mass lightening holes 18, and has an essentially flat upper surface 20 that is continuous from end to end. The rocker arm has a central surface portion 22 that is the contact area between the rocker arm 14 and cam 10. In this case, the contact surface is made concave to serve as an oil or lubricant reservoir to reduce friction between the cam and the surface as the cam pivots the follower about fulcrum 16. As stated previously, it is necessary to retain lubricant at the surface even after engine shutdown because of the time delay in pumping oil to that area after an engine restart.

Figure 2:
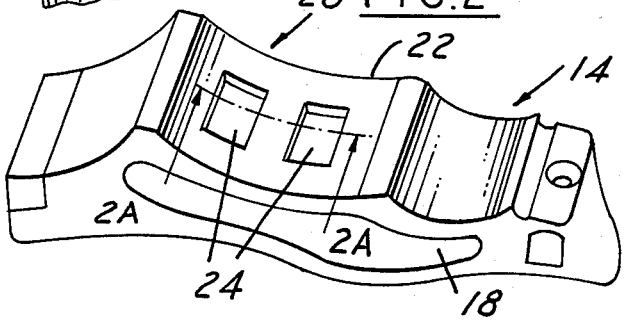
Figure 2A:
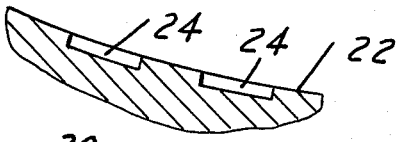
Figure 3:
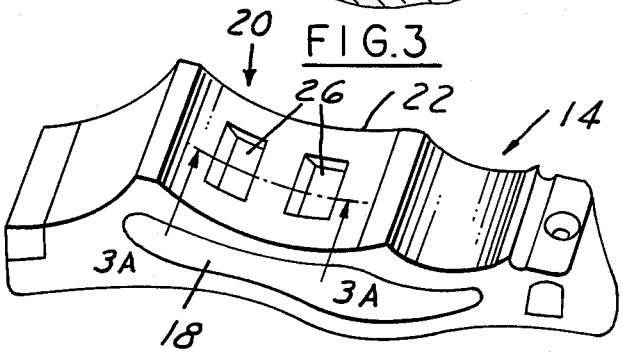
Figure 3A:
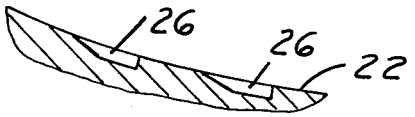
Figure 4:
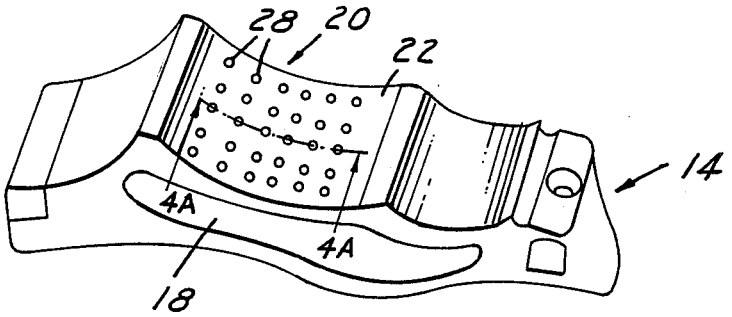
Figure 4A:
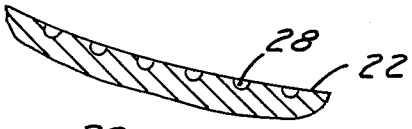

To enhance lubricant or oil retention to the contact surface, provision is made to provide a number of oil retaining pockets at the contact surface. More specifically, FIGS. 2, 2A indicate a construction in which the pockets consist of a pair of rectangularly shaped recesses 24 for retaining the oil. FIGS. 3, 3A show the pockets 24 of FIGS. 2, 2A as having tapered exits 26 for easier egress of the lubricant to the contact surface. FIGS. 4, 4A, on the other hand, show the follower contact surface with an array of small, hemispherical oil retaining pockets 28 that are arranged in rows.

Figure 5:
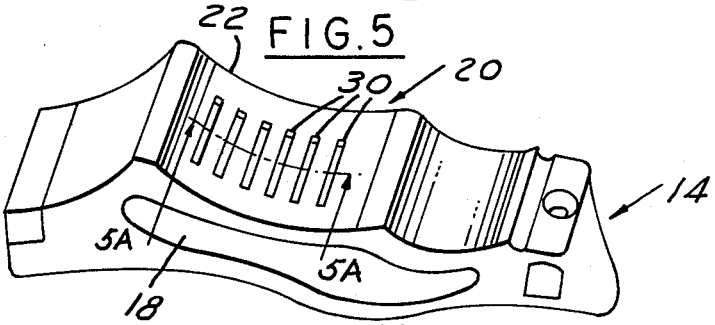
Figure 5A:
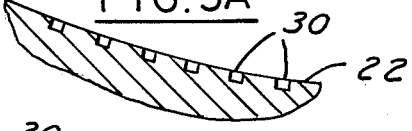
Figure 6:
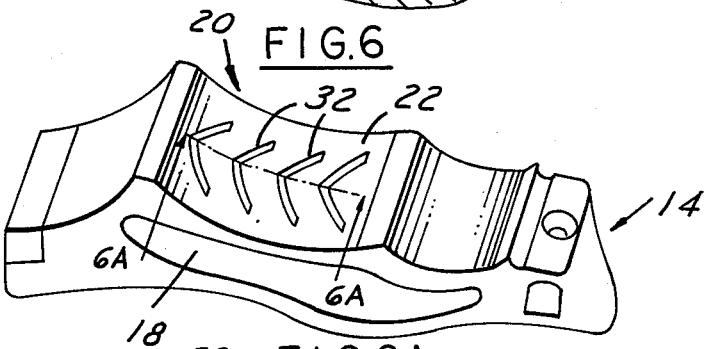
Figure 6A:
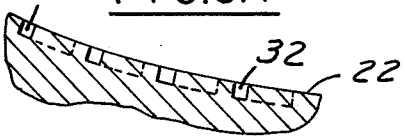

FIGS. 5, 5A show the oil retaining pockets as consisting of a number of narrow parallel grooves 30. And, finally, FIGS. 6, 6A illustrate a construction in which the pockets of FIGS. 5, 5A are herringbone-shaped grooves 32.

In each of the above constructions, it will be clear that oil will be retained in the pockets to ensure that adequate lubrication of the contact surface is maintained. Besides the improved durability, the conformal contact design presented here also reduces the contact stresses. An analysis of the dynamics of the design indicates a 15% reduction in contact stress as compared to a conventional valve train. Lower contact stresses permit the opportunity of selecting more cost effective materials and methods of manufacturing.

Moreover, because of the concave follower geometry, this conformal valve train design requires significantly less height to provide the same valve motion compared to the conventional design. Reducing the height of an overhead cam engine allows more flexibility for packaging the powertrain in the limited space of the engine compartment of the modern aerodynamic vehicles.

From the foregoing, it will be seen that the invention describes a conformal contact overhead cam finger-follower valve train system whose cam to follower contact is a convex geometry on a concave surface instead of the conventional convex-to-convex surface contact; and, therefore, will alleviate many of the wear problems related to the conventional design.

While the invention has been shown and described in its preferred embodiments, it will be clear to those skilled in the arts to which it pertains that many changes and modifications may be made thereto without departing from the scope of the invention.

We claim:

1. A longitudinally extending finger-follower type rocker arm for an automotive type internal combustion engine, the rocker arm consisting of a longitudinally extending body having a solid essentially continuous upper surface from end to end and having means at opposite ends for engagement with a movable valve stem at one end and a stationary lash adjuster type fulcrum at the other end, a central portion of the surface adapted to be contacted by an overhead cam being concave for retaining oil or lubricant directed thereonto and having a plurality of oil containing pockets, and a rotatable overhead cam slidably engaging the central surface portion for pivoting the arm about the end fulcrum upon rotation of the cam.

2. A rocker arm as in claim 1, wherein the central surface includes an array of small hemispherical oil retaining pockets.

3. A rocker arm as in claim 1, wherein the central surface pockets are in rows.

4. A rocker arm as in claim 1, wherein the central surface pockets are in rows of pockets that are rectangularly shaped and spaced from one another.

5. A rocker arm as in claim 3, wherein the pockets are rectangularly shaped and spaced from one another.

6. A rocker arm as in claim 4, wherein the pockets have tapered portions for the exit of the oil therefrom.

7. A rocker arm as in claim 5, wherein the pockets have tapered portions for the exit of the oil therefrom.

8. A rocker arm as in claim 1, wherein the central surface pockets consist of a number of narrow parallel oil retaining grooves.

9. A rocker arm as in claim 8, wherein the grooves are herringbone shaped.

10. An internal combustion engine finger-follower type valve train consisting of an overhead cam, a movable finger-follower rocker arm having a socket at one end engagable by an engine valve stem and another socket at the other end engagable by a stationary lash adjuster constituting a fulcrum for arcuate movement of the follower, the follower having a central portion engaged by the cam for pivoting the follower to move the valve stem, the follower consisting of an essentially flat and essentially unbroken surface extending continuously from end to end and including the central portion, the central portion being slightly concave in cross-section to serve as a lubricant retaining portion for reducing friction between the central surface and the cam when contacted by the cam, and a plurality of lubricant retaining pockets in the central portion surfaces to maintain lubricant at the surface for reducing wear.

* * * * *